US006082277A

United States Patent [19]

Block et al.

[11] Patent Number: 6,082,277

[45] Date of Patent: Jul. 4, 2000

[54] AUTOMATIC FLANGE APPLYING MACHINE

[75] Inventors: Charles Block, North Bellmore; Paul Block, Nesconset; Michael Lydick, Medford, all of N.Y.

[73] Assignee: Galkin Automated Products, Hicksville, N.Y.

[21] Appl. No.: 09/038,266

[22] Filed: Mar. 10, 1998

[51] Int. Cl.[7] ..... D05B 21/00; D05B 27/10; D05B 11/00

[52] U.S. Cl. ..... 112/2.1; 112/309; 112/322; 112/470.33; 112/DIG. 2

[58] Field of Search ..... 112/2.1, 470.07, 112/470.03, 470.33, 470.01, 475.03, 475.04, 308, 309, 318, 322, 306, 153, 470.05, DIG. 2

[56] References Cited

U.S. PATENT DOCUMENTS 5,497,720 3/1996 Kawasaki ..... 112/306 X 5,529,004 6/1996 Porter et al. ..... 112/309 X 5,560,308 10/1996 Eto ..... 112/470.07

*Primary Examiner*—Peter Nerbun

*Attorney, Agent, or Firm*—Paul J. Sutton

[57] ABSTRACT

An automatic flange applying machine for sewing the raw edges of a mattress panel and attaching a flange strip. A multi-speed sewing machine sews at high speed along straight sides and a straight top end and bottom end and forms rounded corners at a slower speed as the mattress panel is incrementally rotated about a pivot point. Photodetectors align the edges of the panel with the sewing needles while other detectors determine the location of the panel so that suitable operations begin. The panel is moved by pressure rollers through the sewing machine and the corners are formed by reversing certain of the rollers.

10 Claims, 4 Drawing Sheets

AUTOMATIC FLANGE APPLYING MACHINE

BACKGROUND OF THE INVENTION

1. Field of the Invention

The invention pertains to mattress construction and more particularly to an automatic machine to attach a flange to a mattress panel.

2. Description of the Prior Art

The standard flange attaching equipment consists of a stationery table, corresponding in surface area to the mattress panel. The quilted panel is laid on this table and the edges are aligned as closely as possible with the table edge. A rail circumvents the legs of this table and corresponds to the dimensions and shape of the table top. This rail supports and guides a carriage which in turn supports a sewing machine equipped with a binding attachment or binder. The sewing machine is mounted in a manner to position the flange material under the panel edge and introduce both the panel edge and the flange material into the binder. A mechanical drive is built into the sewing machine support. This drive engages with a chain or rack gear, either located in the rail or along the outside of the table legs. A paddle on the sewing machine support carriage allows the operator to turn on the sewing machine, which progresses along the rail, in coordination with the feed of the sewing machine. The operator positions himself alongside the sewing machine to allow manipulation of the panel edge and the flange material into the sewing machine binder. This position also requires that the operator walk backwards around the entire table while operating the sewing machine.

SUMMARY OF THE INVENTION

The instant invention overcomes the difficulties noted above with respect to prior art equipment and techniques for attaching a flange to a mattress panel edge by providing an automatic flange applying machine requiring minimum handling by an operator. Flange material is fed from a web and placed under the presser foot of a sewing machine. The mattress panel is placed in the sewing machine and sewing is begun. An overlock stitch closes the open end of the mattress panel and attaches the flange material. A second safety seam is also sewn to further anchor the flange material to the mattress panel. Sewing is conducted on a straight side between limits established by detectors until other detectors detect the end of one side of the mattress panel. When this happens the mattress panel is slowly turned through 90° so that the seams form a rounded corner. Once the rounded corner is completed other detectors initiate straight sewing again. Once all four sides and four corners have been completed a sensor causes any extra threads to be cut and the mattress panel to be ejected from the sewing machine. It is an object of this invention to provide a novel, automatic flange applying machine.

It is an object of this invention to provide a novel automatic flange applying machine which requires a minimum of operator intervention.

It is an object of this invention to provide a novel automatic flange applying machine which sews the straight sides of the mattress panel and has a rotation device for turning the mattress panel through 90° to give rounded corners.

It is an object of this invention to provide a novel automatic flange applying machine where flange material is in the form of a continuous web.

It is still an object of this invention to provide a novel automatic flange applying machine in which most operations are controlled by a plurality of detectors arranged about the machine.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
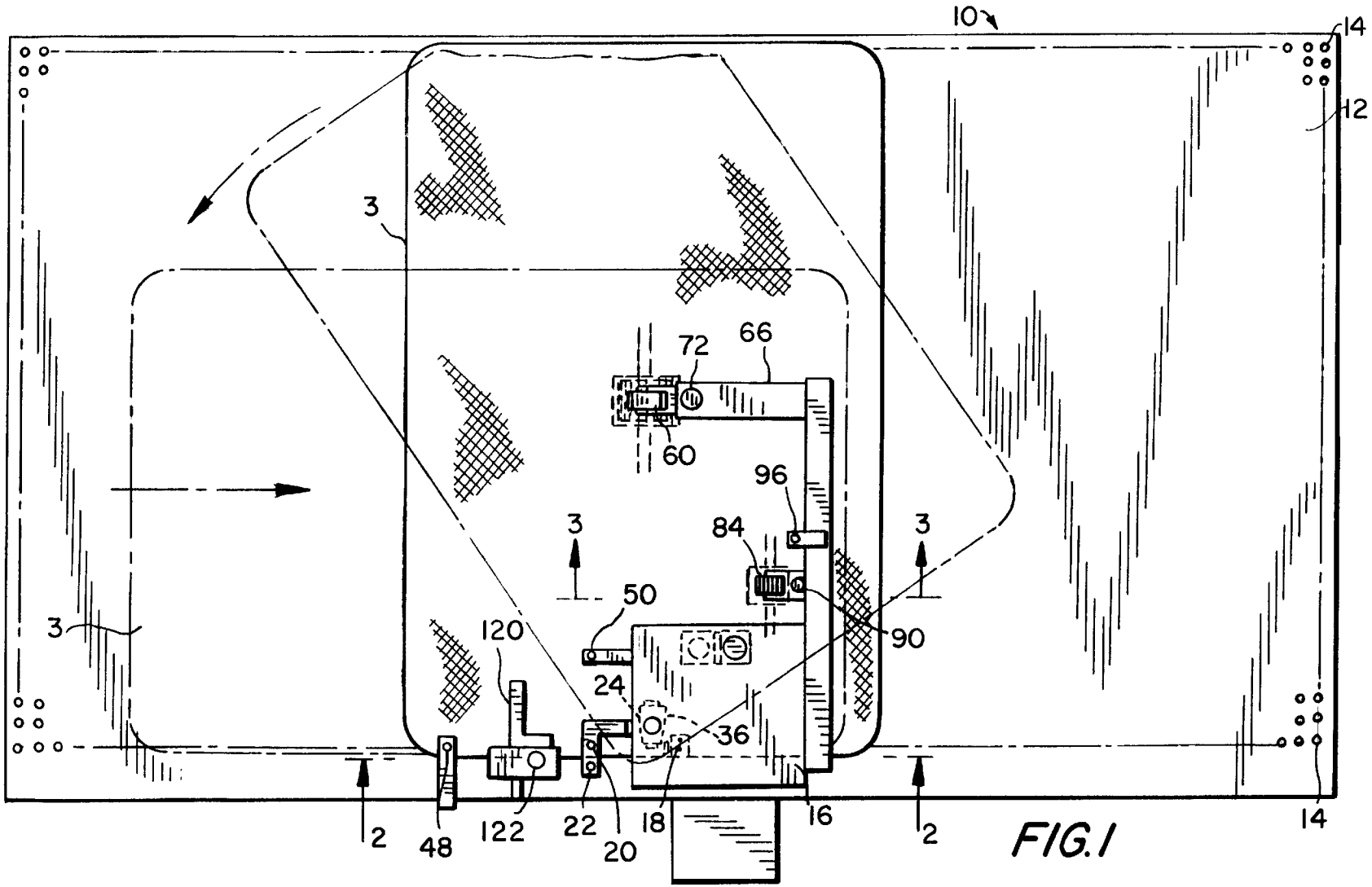
FIG. 1 is a top plan view of an automatic flange applying machine constructed in accordance with the concepts of the invention and showing a mattress panel in various positions on said machine.

Turning now to FIGS. 1–5 an automatic flange applying machine 10 constructed in accordance with the concepts of the invention is shown. A flange, as the terms is used in the mattress construction industry, is a strip of non-woven material about 4 to 6 inches wide that is sewed to the underside of a mattress panel. The top and bottom panels are fixed to the spring unit by means of hog ring clamps or the like. The mattress panel M is made-up of a layer of fabric and one or two layers of foam and the edges of the mattress panel must be joined. A first overlock stitch is used to join the mattress panel edge and the flange. A second or safety stitch provides a further assembly which will be covered by a binding. Mattress panels can be quite large and in the case of a queen sized mattress they are 60 inches by 80 inches and with a king sized mattress 78 inches by 80 inches. To reduce the friction between a mattress panel M and a table surface 12 and to make movement of mattress panel M easier, the table 12 is provided with a number of air holes 14. A pump and distribution lines (not shown) provide air at a positive pressure to each of the holes 14 which minimizes the friction between mattress panel M and the table 12.

Figure 2:
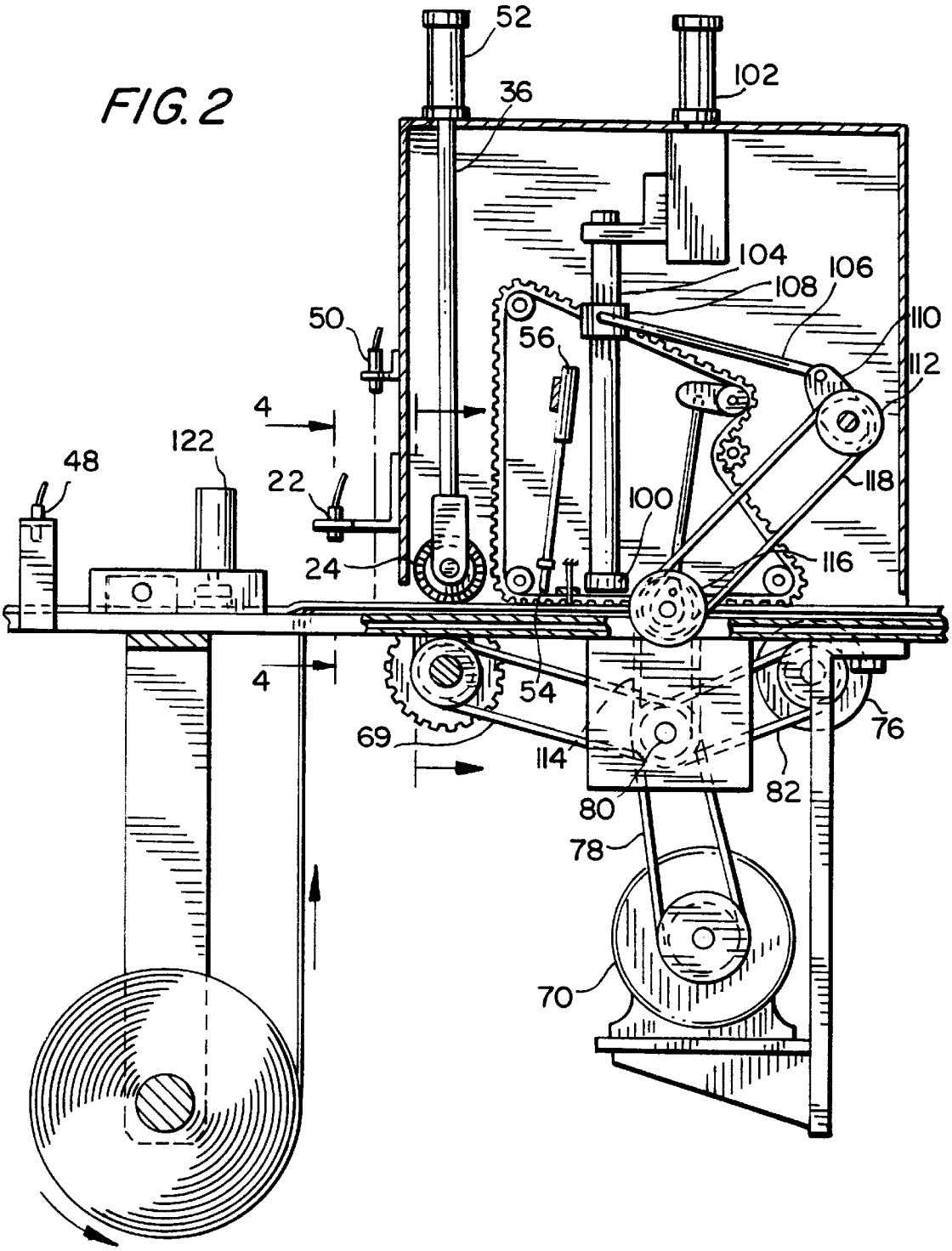
FIG. 2 is a fragmentary, partially in section, side elevational view of a portion of the machine along the lines 2—2 in FIG. 1.
Figure 3:
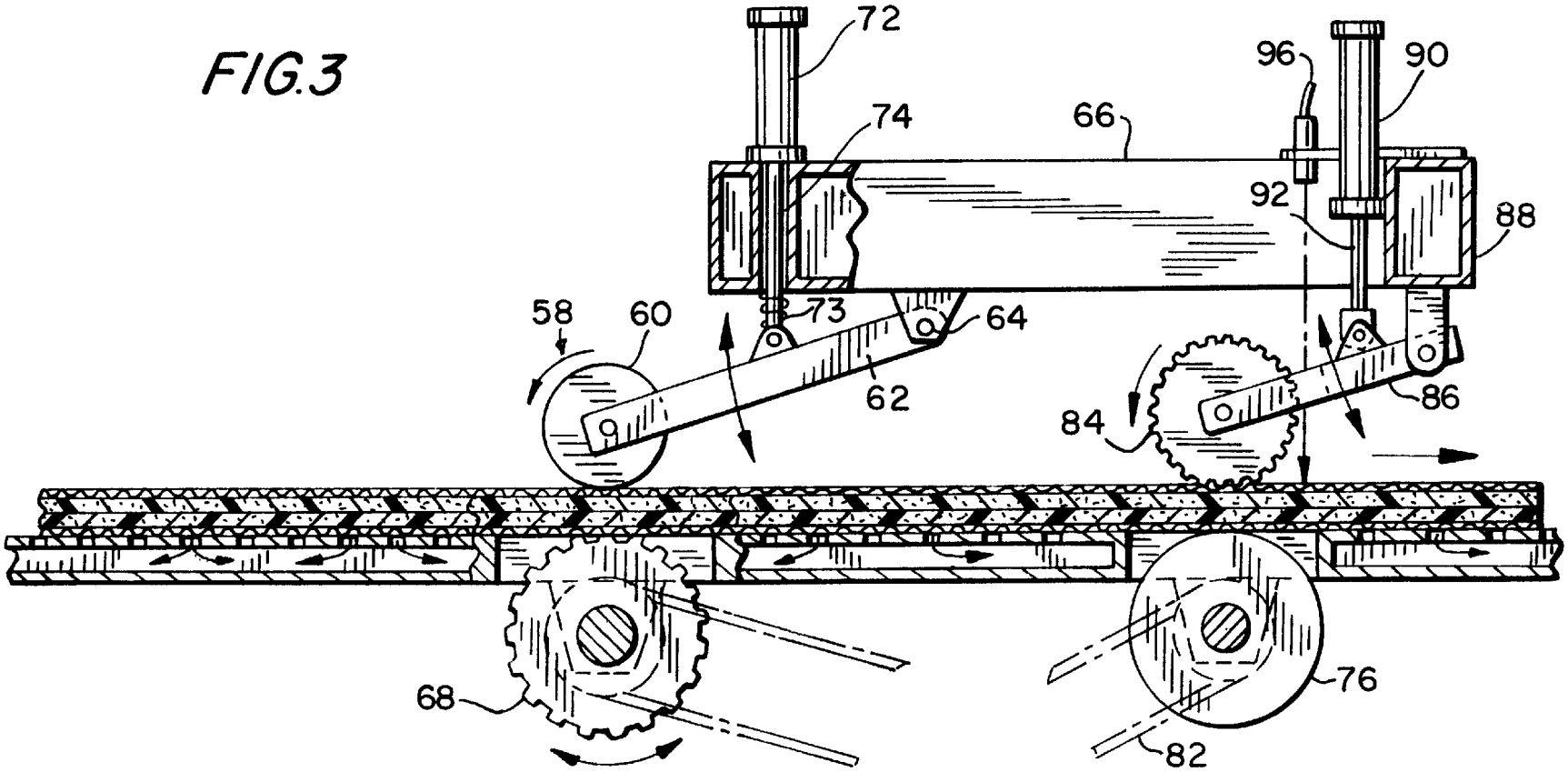
FIG. 3 is a side elevational view, partially in section, of a portion of the machine taken along the lines 3—3 of FIG. 1.
Figure 4:
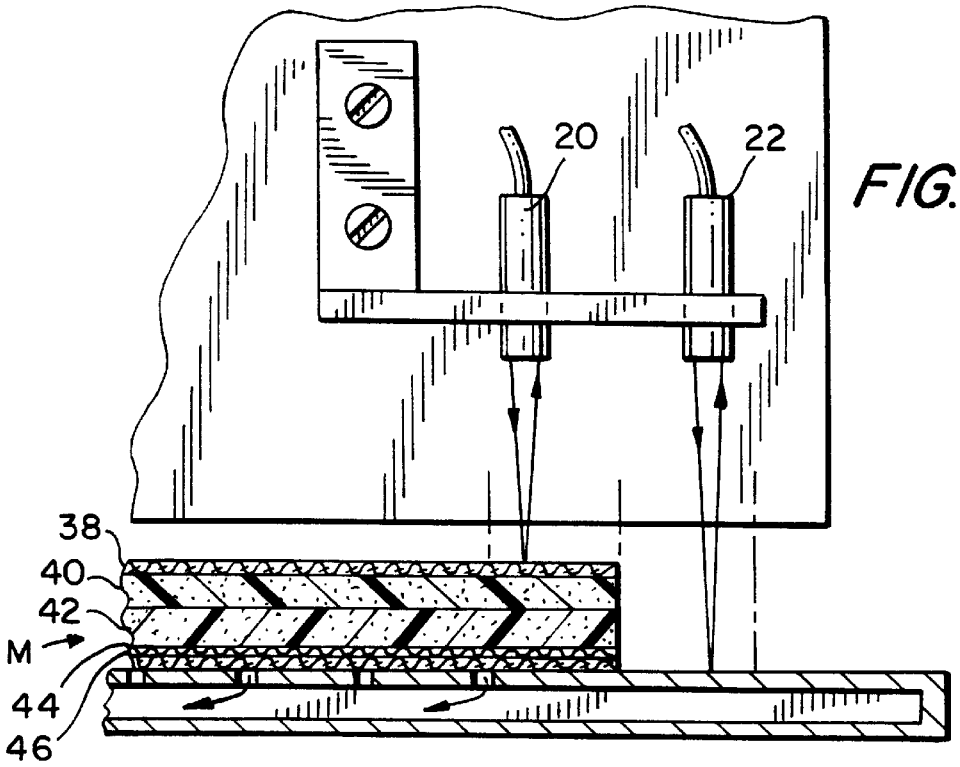
FIG. 4 is a front elevational view, partly in section, of photocell detectors used in the machine and is taken along the lines 4—4 of FIG. 2.
Figure 5:
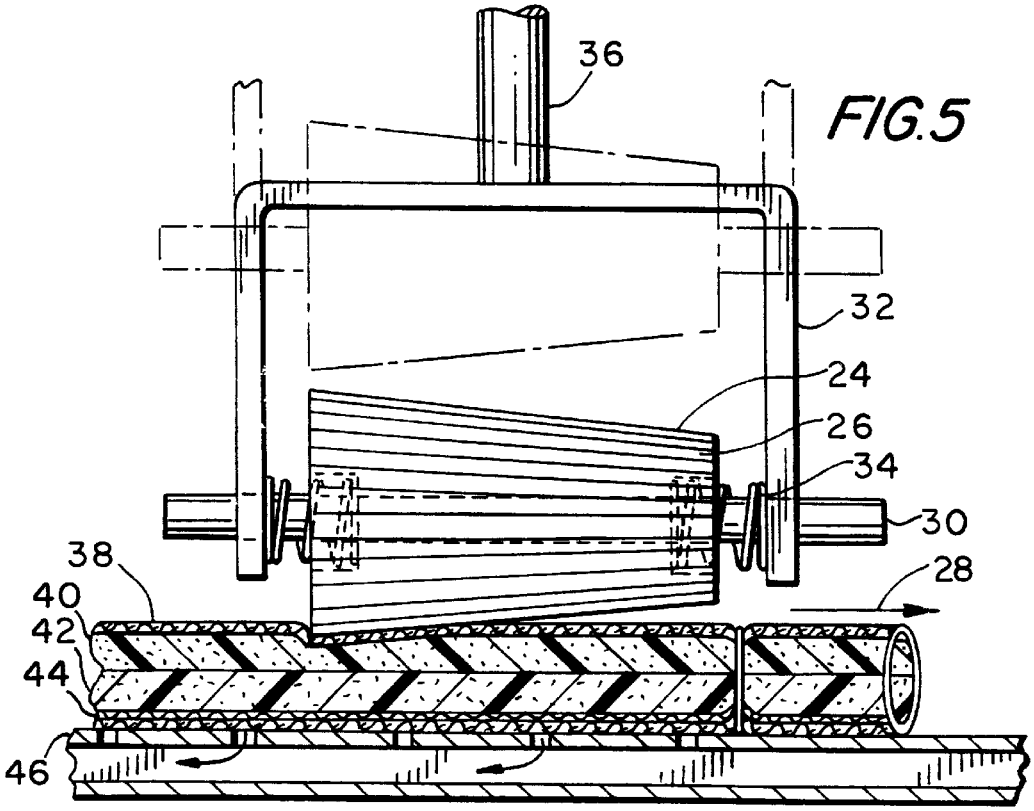
FIG. 5 is a front elevational view of a pressure roller used in the machine of FIG. 1.

The sewing machine 16 has two parallel needles 18 shown only as two dots in FIG. 1 to represent the needles 18, one will do the overlock stitch seam and the other the safety seam (not shown). The machine 10 has first and second photodetectors 20,22 which control the position of the stitches with respect to the edges of the mattress panel M. If photodetector 20 is blocked as shown in FIG. 4, but photodetector 22 is not, this will indicate that the mattress panel M edge is between the photodetectors 20,22 and the position of the mattress panel M is correct. If both photodetectors 20,22 are blocked, the mattress panel M is too close to the needles 18 and the seams will be too close to the mattress panel M edge. With both photodetectors 20,22 open, the mattress panel M has moved too far from the needles 18. The various feed and pressure rollers in the machine 10 have a tendency to move the mattress panel M away from the needles 18 and a truncated conical roller 24 with a ribbed outer surface 26 (see FIG. 5) is used to counter such movement. The roller 24 is driven by the mattress panel M itself and by its shape urges the panel M in the direction of the arrow 28 toward the needles 18. The roller 24 is mounted upon a shaft 30 in frame 32. Springs 34 fix the position of the roller 24 in the frame 32 which may be in contact with the mattress panel M as shown in solid line or withdrawn as shown in the phantom line. The roller 24 is applied by a shaft 36 as shown in FIG. 2. FIG. 4 also shows the arrangement of the materials to be joined. The cover of the mattress panel M is a fabric layer 38 which is joined to two foam layers 40,42 which could also be a single layer or of other suitable materials A further fabric layer 44 may be used or the flange material 46 may be directly applied to the layer 42 without an intermediate fabric layer 44.

A photodetector 48 senses when the corner of the mattress panel M has turned and also indicates that the mattress panel M is completely sewn to the flange material. The photodetector 50 detects the presence of a front edge of the mattress panel M. The short lengths are considered the front and rear ends while the long panels are the sides. The operator checks to see that photodetectors 20, 22, 48 and 50 are all clear or unblocked. The operator loads one of the ends shown in solid line into the sewing machine 16 with the center line of the end lining up with the needles 18. The operator must load the mattress panel M such that photodetectors 20, 22, 48 and 50 are blocked. This insures that the mattress panel M is initially loaded properly and aligned to the sewing machine 16 needles 18. The operator then depresses a foot pedal (not shown) starting the sewing cycle. The front pressure roller 24 is brought down upon the panel M edge and flange material 46 (see FIG. 2) by an operating cylinder 52 forcing the shaft 36 downwardly. Thus roller 24 pre-compresses the mattress panel M and flange 46 prior to its entry into the sewing machine 16. The roller 24 also applies drag to the top surface of the materials 38 of the mattress panel M, smoothing out wrinkles and pleats. The open presser foot 54 is operated by a pressure line (not shown) attached to operating cylinder 56 adding compressive force to the surface of the presser foot 54. A side feed roller 58 has a top smooth roller 60 mounted upon a brace 62 pivotally pinned as a 64 to an arm 66. The side feed roller 58 has a ribbed outer surface roller 68 which is driven from motor 70 through belt 78, intermediate pully 80 and belt 69 as shown in FIG. 2. When the operating cylinder 72 is pressurized the brace 62 is forced down by shaft 74 bringing roller 60 into contact with the mattress panel M and flange 46. This downward movement of roller 60 brings the materials in further contact with ribbed roller 68 to advance the materials. The direction of travel of ribbed roller 68 can be reversed thereby changing the direction of movement of the panel and flange. For example, if roller 68 is driven in the clockwise direction the mattress panel M and flange 46 will advance through sewing machine 16. If roller 68 is run in a counter-wise direction then the mattress panel M and flange 46 are driven backwardly. When used in the reverse mode, roller 68 going counter-clockwise, it assists in moving the mattress panel M towards the sewing needles 18. Also, as will be described below, when the mattress panel M is clamped the rollers 60 and 68 cause the panel M to be rotated through 90° to bring another side or end to the sewing machine 16.

A rear drive assembly is made up of a smooth roller 76 driven by the motor 70 through a belt 78 and intermediate pulley 80 and another belt 82. Roller 76 is constantly run in the same clockwise direction. A ribbed roller 84 cooperates with roller 76 to drive the mattress panel M and flange 46 which is held between the rollers 76 and 84. The ribbed roller 84 is mounted upon a brace 86 which is pivotally mounted to cross arm 88. An operating cylinder 90 controls the position of roller 84 via shaft 92. When the mattress panel M and flange 46 are not pressed against the surface of roller 76 no forces are applied to the mattress panel M and flange 46. With the rollers 60 and 84 engaged with the mattress panel M and flange 46, the mattress panel M and flange 46 are driven forward with the needles operating at their high speed setting. Since it is desired that the two seams, described above, be at a uniform distance from the panel edge, the photodetectors 20 and 22 are employed as set forth above with respect to FIG. 4. When the mattress panel M and flange 46 are positioned, during sewing such that photodetector 20 is blocked and photodetector 22 is open, the sewing machine 16 will run and the side roller 60 will be maintained in contact with mattress panel M and flange 46 to maintain its bite into the outside edge of the mattress panel M and flange 46 and advance such materials through sewing machine 16. When both photodetectors 20,22 become open, the side roller operating cylinder 72 is depressurized but a light spring 73 holds roller 60 down minimally into the loft of the mattress panel M and flange 46 as it is sewn. This effectively eliminates any pulling influence of the roller 60 on the mattress panel M and flange 46 outside edge. With this external force removed, the sewing machine 16 has a natural tendency to pull the material back in towards itself. The roller 60 remains depressurized until the condition of photodetector 20 blocked and photodetector 22 is open is again achieved. When the photodetectors 20,22 both become blocked a signal is applied to sewing machine 16 to cause it to temporarily disengage allowing roller 60 to pull the mattress panel M and flange 46 the distance necessary to return the condition of photodetector 20 blocked and photodetector 22 open.

The rear roller 84 is controlled by means of a photodetector 96 which senses the edge of the mattress panel M and flange 46 at the centerline of roller 84 to the point where it can be pulled. The photodetector 96 applies a signal to operating cylinder 90 which lowers the roller 84. This action occurs automatically throughout the cycle as end or side surfaces of the mattress panel M and flange 46 are presented.

When the mattress panel M and flange 46 are almost completely sewn down a side or edge, it must be prepared to rotate 90° and make a sewn radius corner. A photodetector 50 senses when the back edge is properly positioned relative to sewing machine 16 and stops all sewing when this edge arrives and opens the photodetector 50. With the mattress panel M and flange 46 are stopped, the front presser roller 24 is lifted up and out of contact with the mattress panel M. The rotate plate 100 is operated by operating cylinder 102 through shaft 104. The rotate plate 100 produces a pivot point about which the mattress panel M and flange 46 will turn and make an appropriate corner. When rotate plate 100 drops down, a switch (not shown) is activated which reverses the direction of the side feed roller 68 to feed the mattress panel M and flange 46 in the opposite direction. The rear puller roller 84 is deactivated by deenergizing operating cylinder 90 and is lifted up by the shaft 92. The sewing machine is shifted to its low sewing speed setting and begins to sew. The side. feed roller 68 begins to turn in reverse in its low speed range setting. The low speed is set such that the corner radius is finished as the raw edge arrives between photodetectors 20,22 rotating a full 90° see the mattress panel M shown in phantom line in FIG. 1. Once the edge arrives and blocks photodetector 20, the sewing and rotating stop immediately.

The rotate plate 100 is not a fixed point but rather rotates through an angle of 90° itself coordinated with the turning of the mattress panel M. This prevents possible tearing of the mattress panel M fabric. The rotate plate 100 is rotated incrementally, in for example 2° increments. This is done by an eccentric arm 106 connected to collar 108 on shaft 104. Each time eccentric 110 is rotated by pulley 112 driven from motor 70 via belt 78, intermediate pulley 80, belt 114, pulley 116 and belt 118, it operates the eccentric arm 106.

With the sewing and rotation of rotate plate 100 stopped, the rotate plate 100 is retracted by depressurizing operating cylinder 102 which causes the disengagement of the reverse feed switch (not shown) which permits the side feed roller 68 to go to the forward feed mode. The same steps, as noted above, from the operation of the presser foot 54 on are carried out on the remaining three corners. After the fourth corner has been sewn, the sewing machine 16 sews down the last edge (now half sewn/half raw edge) until the photodetector 48 is found to be clear or open. This tells the sewing machine 16 that it is time to begin moving the mattress panel M and flange 46 away from the sewing machine 16, so that the starting sew lines and ending sew lines can meet and then move the completed mattress panel M completely out of the machine leaving a small line of threads between the sewing machine and mattress panel M which will be cut prior to the finished panel's removal. The mattress panel M with flange 46 attached is pushed away from the sewing machine 16 by means of an arm 120 operated horizontally by an operating cylinder 122. A signal is sent to the flange knife cutting the flange 46 away from the panel M (not shown). Once the side edge arrives at its outside stroke extreme, a limit switch (not shown) is activated stopping all sewing and feeding. The side feed roller 60 is lifted up and the mattress panel M and flange 46 are free to be removed after the thread is trimmed.

While there have been shown and described and pointed out the fundamental novel features of the invention as applied to the preferred embodiment as is presently contemplated for carrying them out, it will be understood that various omissions and substitutions and changes of the form and details of the device illustrated and in its operation may be made by those skilled in the art, without departing from the spirit of the invention.

We claim:

1. An automatic flange applying machine for applying a flange to the edges of a mattress panel comprising:

a) a sewing machine for sewing said flange to the edges of a mattress panel;

b) means for providing a continuous web of flange material adjacent said sewing machine;

c) means for moving said flange material and said mattress panel through said sewing machine, said means for moving comprising a first pair of rollers, a first roller of said first pair of rollers being driven constantly in a first direction and a second roller of said first pair of rollers being a first pinch roller to selectively pinch said mattress panel and flange material between said first and second rollers and advance said mattress panel and said flange material in a direction into said sewing machine; a second pair of rollers, a third roller of said second pair of rollers being selectively driven in one of said first direction and a second opposite direction and a fourth roller of said second pair of rollers being a second pinch roller to selectively pinch said mattress panel and said flange material between said third and fourth rollers to advance said mattress panel and said flange material in said direction into said sewing machine or in a direction opposite said direction and away from said sewing machine depending upon whether said third roller is being driven in said first direction or said second direction;

d) detector means for detecting the position of said mattress panel and coupled to said means for moving to control the movement of said flange material and said mattress panel; and e) means to rotate said mattress panel and flange material through a 90° turn at the end of any straight side or end of said mattress panel.

2. An automatic flange applying machine, as defined in claim 11, further comprising:

a) a support table adjacent said sewing machine for supporting said mattress panel as it is being sewed;

b) said support table having a plurality of air holes from a back surface to a front surface; and c) air means coupled to said back surface of said support table to provide positive pressure air to said air holes.

3. An automatic flange applying machine, as defined in claim 11, further comprising:

a) a first photodetector to detect the position of an edge of said mattress panel;

b) a second photodetector, separated from said first photodetector, to detect the position of an edge of said mattress panel; and c) said first and second photodetectors operating in concert to identify that an edge of a panel is properly placed when photodetector one detects an edge but photodetector two does not, that the edge of the panel is too close to said sewing machine when both said first and second photodetectors detect an edge and that an edge of a panel is too far from said sewing machine when neither of said photodetectors detect an edge of a mattress panel.

4. A automatic flange applying machine, as defined in claim 11, wherein said means to rotate said mattress panel and flange material is a stepped plate which rotates with the mattress panel and flange material.

5. An automatic flange applying machine for applying a flange to the edges of a mattress panel comprising:

a) a sewing machine for sewing said flange to the edges of a mattress panel;

b) means for providing a continuous web of flange material adjacent said sewing machine;

c) means for moving said flange material and said mattress panel through said sewing machine; said means for moving said mattress panel and said flange material through said sewing machine comprises;

i. a constantly rotating in one direction first drive roller;

ii. a first pressure roller selectively brought into contact with said mattress panel and said flange material passed between said first drive roller and said first pressure roller;

iii. means to force said first pressure roller against said mattress panel and said flange material and into said first drive roller;

d) detector means for detecting the position of said mattress panel and coupled to said means for moving to control the movement of said mattress panel and flange material; and e) means to rotate said mattress panel and flange material through a 90° turn at the end of any straight side or end of said mattress panel.

6. An automatic flange applying machine for applying a flange to the edges of a mattress panel comprising:

a) a sewing machine for sewing said flange to the edges of a mattress panel;

b) means for providing a continuous web of flange material adjacent said sewing machine;

c) means for moving said flange material and said mattress panel through said sewing machine; said means for moving said mattress panel and said flange material through said sewing machine comprises:

i. a reversible, constantly rotating first drive roller;

ii a first pressure roller selectively brought into contact with said mattress panel and said flange material passed between said first drive roller and said first pressure roller and moved according to the direction of rotation of said first drive roller; and iii. means to force said first pressure roller against said mattress panel and said flange material and into said first drive roller;

d) detector means for detecting the position of said mattress panel and coupled to said means for moving to control the movement of said flange material and said mattress panel; and e) means to rotate said mattress panel and flange material through a 90° turn at the end of any straight side or end of said mattress panel.

7. An automatic flange applying machine for applying a flange to the edges of a mattress panel comprising:

a) a sewing machine for sewing said flange to the edges of a mattress panel;

b) means for providing a continuous web of flange material adjacent said sewing machine;

c) means for moving said flange material and said mattress panel through said sewing machine; said means for moving said mattress panel and said flange material through said sewing machine further comprises:

i. a reversible, constantly rotating second drive roller;

ii. a second pressure roller selectively brought into contact with said mattress panel and said flange material pressed between said second drive roller and said second pressure roller and moving according to the direction of rotation of said second drive roller; and iii. means to force said second pressure roller against said mattress panel and flange material and into said second drive roller;

d) detector means for detecting the position of said mattress panel and coupled to said means for moving to control the movement of said flange material and said mattress panel; and e) means to rotate said mattress panel and flange material through a 90° turn at the end of any straight side or end of said mattress panel.

8. An automatic flange applying machine, as defined claim 6, wherein:

a) said first driver roller has a ribbed surface; and b) said first pressure roller has a smooth cylindrical shape.

9. An automatic flange applying machine; as defined in claim 6, wherein:

a) said first drive roller has a smooth cylindrical surface; and b) said first pressure roller has a ribbed surface.

10. An automatic flange applying machine, as defined in claim 7, wherein:

a) said first drive roller has a smooth cylindrical surface;

b) said first pressure roller has a ribbed surface;

c) said second drive roller has a ribbed surface; and d) said second pressure roller has a smooth cylindrical surface.

* * * * *